US005622387A

United States Patent [19]

Ordway

[11] Patent Number: 5,622,387

[45] Date of Patent: Apr. 22, 1997

[54] BOOKMARK

[76] Inventor: Griffin Ordway, 662 Matagual Dr., Vista, Calif. 92083

[21] Appl. No.: 404,593

[22] Filed: Mar. 15, 1995

[51] Int. Cl.[6] ..... B42D 9/00

[52] U.S. Cl. ..... 281/42

[58] Field of Search ..... 281/42, 51, 28

[56] References Cited

U.S. PATENT DOCUMENTS

| | | | |
|---|---|---|---|
| 370,525 | 9/1887 | Bieber | 281/42 |
| 4,505,219 | 3/1985 | Mangano | 281/42 X |

*Primary Examiner*—Willmon Fridie, Jr.
*Attorney, Agent, or Firm*—Henry G. Kohlmann

[57] ABSTRACT

A bookmark which will hold its place in a book and holds the book in a closed position. This is accomplished by attaching an elastic cord or band to the top of the bookmark at a position spaced apart from the binding. When the elastic cord or band is positioned for storage of the book the band encircles the covers of the book and causes the body of the bookmark to be biased against the binding of the book. When reading of the book is again desired the bookmark is held in place by grasping the book near the binding with the fingers and removing the elastic strap or cord attached to the book mark. The specific structure of the instant invention allows ease of removal of the elastic strap holding the book covers closed without having the bookmark fall out of the book while attempting such removal.

13 Claims, 5 Drawing Sheets

BOOKMARK

BACKGROUND OF THE INVENTION

1. Field of the Invention

The field of this invention relates generally to book marks and their use in books to perform functions in addition to the separation of pages. More specifically this invention relates to bookmarks which permit functions other than the separation of pages. These additional functions include multiple separation of pages and positional marking of lines of text in pages.

2. Description of Related Art

The related art is typified in U.S. Pat. No. 1,222,023 to PERRY and U.S. Pat. No. 2,424,541 to BOOTH. None of the prior art devices show an elastic means for biasing the base of the bookmark into the bindings and at the same time holding the covers closed. Some show the use of elastic members used to hold the bookmark against the bindings such as in U.S. Pat. No. 1,858,605 to ALVENSLEBEN, however, the prior art devices are used to hold the bookmark in place when reading the book as well as when the book is stored and necessarily requires that the covers not be biased closed.

SUMMARY OF THE INVENTION

The instant invention comprises a bookmark which will hold its place in a book and holds the book in a closed position while remaining securely positioned in the book. This is accomplished by attaching an elastic cord or band to the top of the bookmark at a position spaced apart from the binding. When the elastic cord or band is positioned for storage of the book the band encircles the covers of the book and causes the body of the bookmark to be biased against the binding of the book. When reading of the book is again desired the bookmark is held in place by grasping the book near the binding with the fingers and removing the elastic strap or cord attached to the book mark. The specific structure of the instant invention allows ease of removal of the elastic strap holding the book covers closed without having the bookmark fall out of the book while attempting such removal. The bookmark of the instant invention will remain in place even when the book is dropped or otherwise mishandled.

DESCRIPTION OF THE PREFERRED EMBODIMENT(S)

Figure 1:
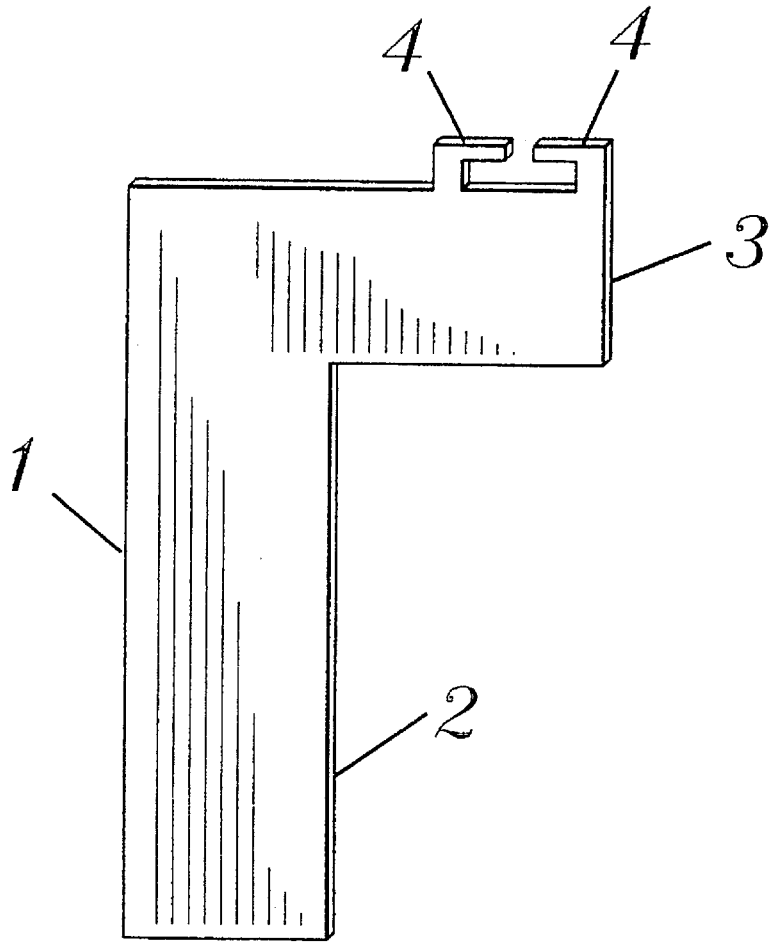
FIG. 1 is a perspective view of the body of the bookmark.
Figure 2:
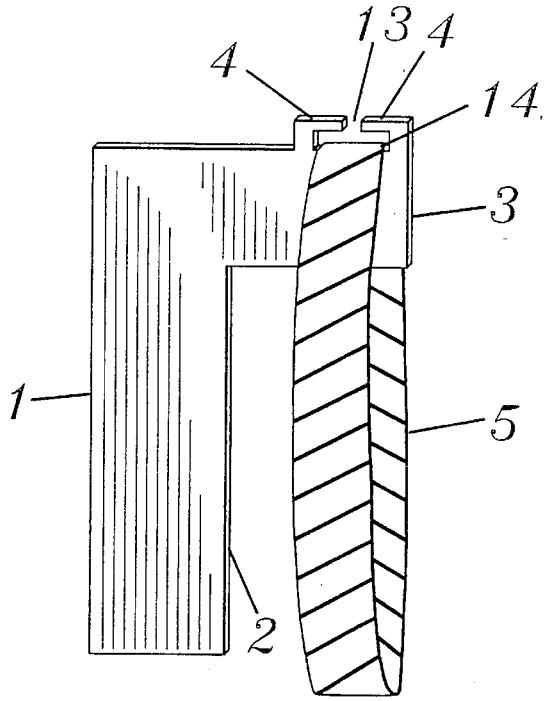
FIG. 2 is a perspective view of the body of the bookmark with the elastic strap in place.

With reference to the drawings, FIG. 1 shows the preferred embodiment of the bookmark 1, which is in the form of an inverted L. The bookmark 1 has an elongated body portion 2 which is integral with an elongated arm 3 disposed generally at a 90° to the central axis of said body portion. The arm 3 supports a pair of mounting brackets 4 which are adapted to receive an elastic loop which may be a rubber band, an elastic cord, elastic strap or other suitable elastic material. The bookmark 1 is made of plastic but may be made of any semi-rigid material, including paper, wood or other suitable material. FIG. 2 shows the bookmark 1 with the elastic loop 5 in place between brackets 4. The brackets 4 are attached at their base to arm 3 and spaced apart a distance smaller than the width of the elastic loop 5 at a first opening 13 between the brackets. Said brackets 4 form a second opening 14 at the base of the brackets which is sufficient to allow free movement of the elastic loop 5 over the arm 3.

Figure 3:
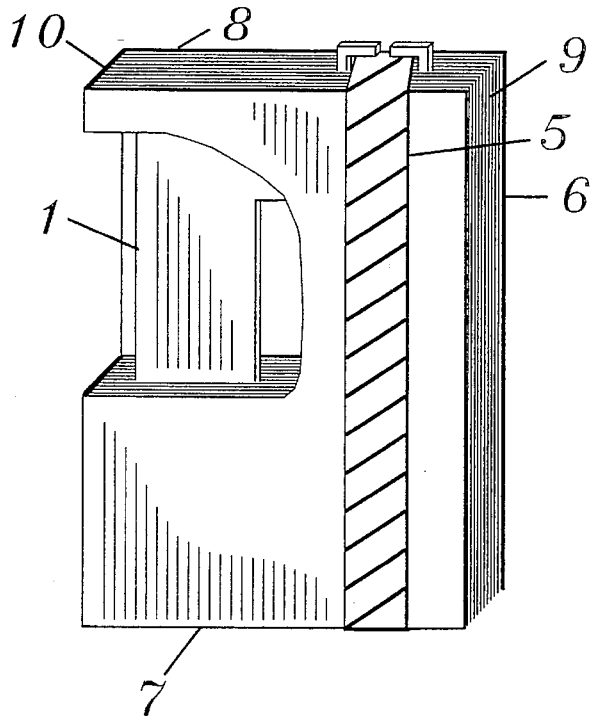
FIG. 3 is a perspective view of the bookmark positioned in a book.

In use the bookmark is positioned in a book 6 between a number of pages 9 as shown in FIG. 3. The book 6 has a front cover 7 and a rear cover 8. When in place, the elastic loop 5 of the bookmark 1 is stretched about the front cover 7 and the rear cover 8 and holds the covers closed. At the same time the elastic loop 5 biases the elongated body portion of the bookmark against the binding 10 of the book, as shown in the cutaway portion, by exerting a downward pressure on the arm of the bookmark and securely holds the bookmark 1 in position in the book 6.

Paper back books quickly become dogeared, creased, torn and their bindings broken resulting in loose pages. In addition, they often tend to fan open after even limited use. The instant invention not only keeps the page location but also protects the covers and the binding of the book and retains loose pages all by keeping the book in a closed position when it is not being read.

When reading of the book 1 is desired, the removal of the elastic loop 5 is accomplished by grasping the book 6 near the binding 10 thereby holding the bookmark 1 in place while the elastic loop 5 is slipped off the covers of the book 6. The elastic loop 5 may then be allowed to hang loose and the bookmark 1 may then be used like any other bookmark until storage is again desired.

Figure 4:
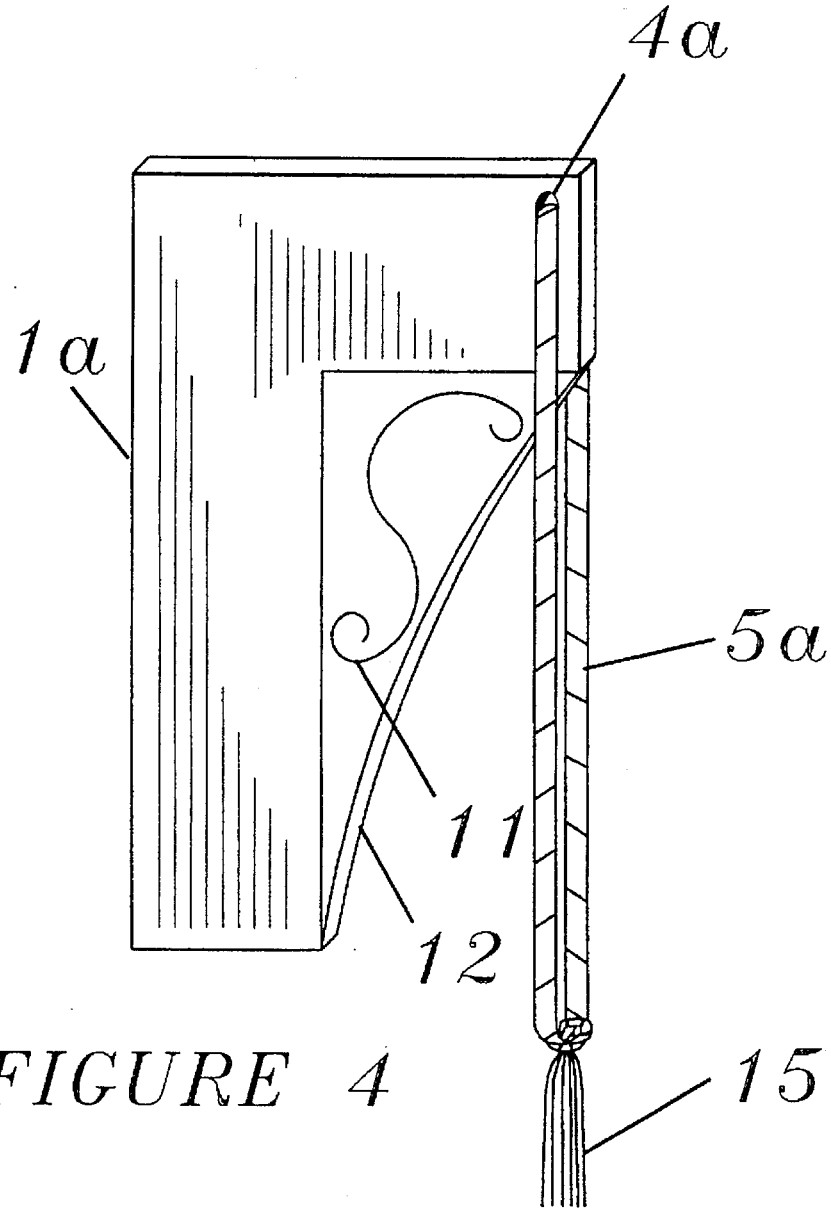
FIG. 4 is a perspective view of an alternative bookmark and cord.

While the bookmark 1 has been shown in the preferred embodiment as an inverted L, there are many other shapes which are equivalent to the instant device. FIG. 4 shows a generally triangular shaped bookmark 1*a* with a decorative design along a slightly curved side of the bookmark 1. In fact, a multitude of shapes would suffice provided that they have a side which may be positioned against the binding of the book 6, an upper arm which may be held in place by the fingers when removal of the elastic loop is desired and a means for permitting the connection of an elastic loop at least one end thereof.

FIG. 4 shows an elastic cord 5*a* which is connected to the bookmark 1 through a hole 4*a* in the arm 3 which performs the same purpose as the brackets 4 in the first preferred embodiment. The cord 5*a* is fed through the hole 4*a* which is slightly larger in diameter than the cord 5*a* and the cord 5*a* is then tied or otherwise fastened at one as shown in FIG. 4. A decorative tassel 15 or other ornamentation may be added. The alternate bookmark 1 operates in the same manner as the first preferred embodiment with the exception that it protrudes slightly above the book when in place due to the cord 5*a* passing through the hole 4*a* when stretched around the book 6.

Figure 5:
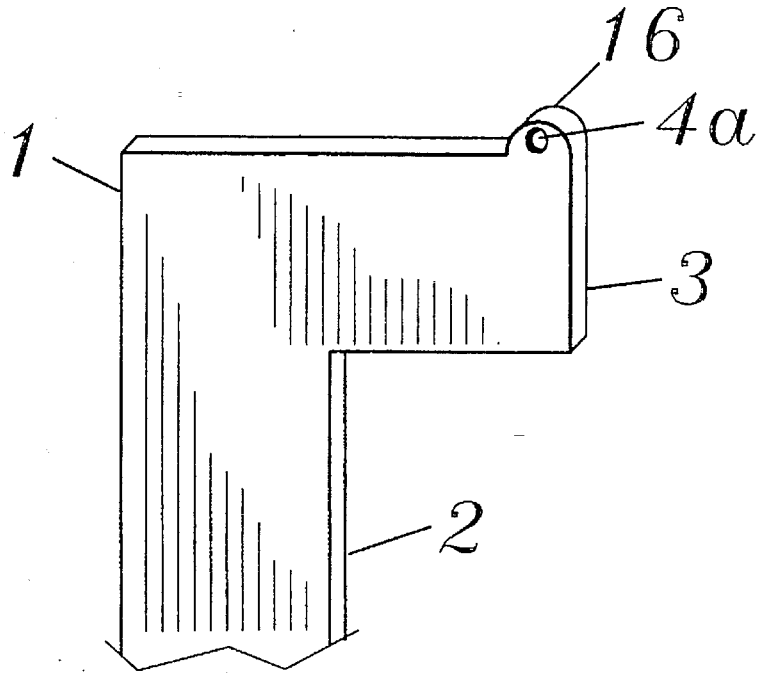
FIG. 5 is a perspective view of an alternative bookmark with a raised hole.

FIG. 5 shows another alternative position for the hole 4*a* which is positioned in a slightly raised portion 16 of arm 3 which protrudes above the pages of the book 6 as do the brackets 4.

In the case of the elastic loop 4 or the cord 4*a* the overall inside circumference of the loop should be smaller than or equal to the outside circumference of the book 6 so that the elastic loop 5 or the cord 5*a* will be stretched and bias the book 6 covers in a closed position when the elastic loop 5 or the cord 5*a* encircle the book cover. Multiple sizes of the book mark 1 are contemplated within the scope of this invention dependent on the size of various books.

The position of the raised portion 16, hole 4*a* or the brackets 4 may be positioned at any point along the top of the bookmark 1 provided that a sufficient bias force must be imparted to the covers to cause them to remain closed and still permit a grasping of the sides of the book adjacent the binding with the fingers to engage the bookmark 1.

Figure 6A:
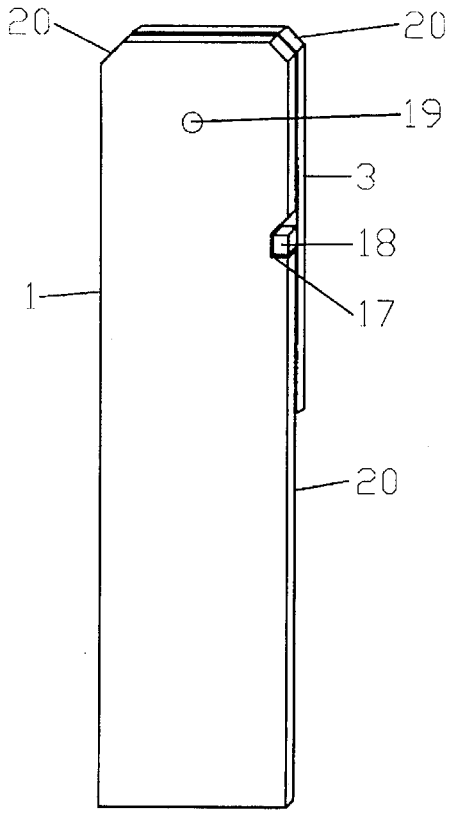
FIGS. 6*a* and 6*b* are perspective views of an alternative bookmark having a rotatable arm.
Figure 6B:
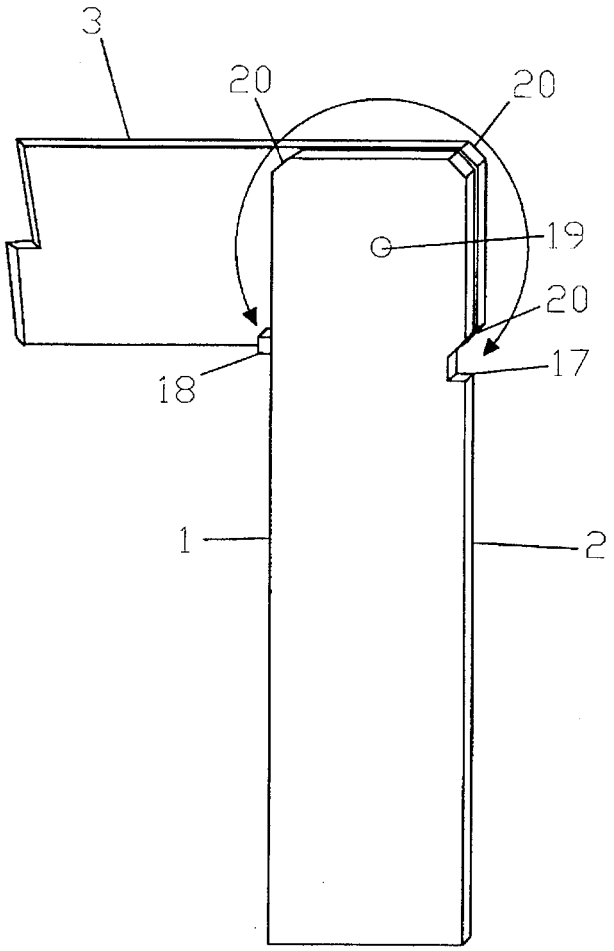

Another alternative embodiment is shown in FIG. 6*a*, and 6*b*. FIG. 6*a* and 6*b* show the bookmark 1 having an elongated body portion 1, rotatably attached to an arm 3. Said body portion 2 has a notch 17 for receiving a pin 18 when the bookmark 1 is rotated into a closed position as shown in FIG. 6*a*. When the Bookmark one is rotated onto an open position the pin 18 acts as a stop against elongated body portion 2 and holds the arm 3 substantially perpendicular to said body portion 2 as in the integral version of the invention. Elastic members may be attached by any of the means described for the integral version. However, the rotatable version permits easy storage of the device when rotated closed and use as a straight edge or a ruler provided graduated markings, not shown, are placed along the sides thereof. Rotational attachment is accomplished by providing a hole 19 near the top of the body portion 2 which corresponds to a similar hole in the arm 3 and may be attached by a rivet or any other means known in the art which allows rotation. In addition the body portion 2 has beveled edges 20 on either side of the top which permits passage of the pin 18 past the upper corners. Arm 3 has corresponding beveled edges opposite the end to which the elastic member is attached, for aesthetic reasons.

Having thus described the invention, what is claimed is:

1. A bookmark for insertion into a book comprising:

a. a body adapted for extending downward along the binding of said book, b. an arm extending outward from the body attached on one side thereof to the top of the body having a pair of brackets comprising a base at one end and a tip at the other spaced apart and attached at the base of said brackets to the top of said arm and disposed opposite said base portion, said brackets spaced apart a distance less than the width of the elastic loop at the tip of said brackets and spaced apart at the base of said brackets a distance greater that the distance between said tips c. means for releasably engaging the covers of the book and for biasing said body against said binding attached to said arm through said brackets and spaced apart from said body which comprises an elastic loop attached to said arm adapted for encircling the covers of the book and biasing said covers closed about said body.

2. A bookmark as described in claim 1 wherein said brackets have hook shaped ends disposed toward one another.

3. A bookmark for insertion into a book comprising:

a. a body adapted for insertion between the pages of said book and extending downward along the binding of said book, b. a arm extending outward from the body attached to the top of the body having a pair of brackets comprising a base at one end and a tip at the other spaced apart and attached at the base of said brackets to the top of said arm, said brackets spaced apart a distance less than the width of the elastic loop at the tip of said brackets and spaced apart at the base of said brackets a distance greater that the distance between said tips, and c. an elastic loop attached to said arm by engagement with said brackets and spaced apart from said body and adapted for encircling the covers of the book and biasing said body toward said binding.

4. A bookmark as described in claim 3 wherein said brackets have hook shaped ends disposed toward one another.

5. A bookmark for insertion into a book comprising:

a. a body adapted to extend downward along the binding of said book, b. an arm extending outward from the binding of the book attached to the body and c. a means for releasably engaging the covers of said book attached to said arm.

6. A bookmark as described in claim 5 wherein said body comprises a hole in one end of said body registered with a corresponding hole in one end of said arm, which holes receives a fastener which holds said body and said arm in juxtaposition with one another and permits relative rotation between them.

7. A bookmark as described in claim 6 wherein said releasably engaging means further comprises an elastic loop attached to said arm adapted for encircling the covers of the book and biasing said covers closed about said body portion.

8. A bookmark as described in claim 7 wherein said elastic loop comprises a rubber band having a relaxed state inner circumference which is equal to or less than the outer circumference of said book.

9. A bookmark as described in claim 7 wherein said elastic loop comprises a band of elastic fabric having a relaxed state inner circumference which is equal to or less than the outer circumference of said book.

10. A bookmark for insertion into a book comprising:

a. a body portion adapted for extending downward along the binding of said book, b. a arm extending outward from the binding of the book attached to the top of the body portion, and c. an elastic loop attached by engagement with a pair of brackets having a base at one end and a tip at the other spaced apart and attached at the base of said brackets to the top of said arm and disposed opposite said base portion, said brackets spaced apart a distance less than the width of the elastic loop at the tip of said brackets and spaced apart at the base of said brackets a distance greater that the distance between said tips and to said arm adapted for encircling the covers of the book and biasing said covers closed about said body portion.

11. A bookmark as described in claim 10 wherein said brackets have hook shaped ends disposed toward one another.

12. A bookmark for insertion into a book comprising:

a. a body portion adapted for insertion between the pages of said book and extending downward along the binding of said book, b. a arm extending outward from the binding of the book attached to the top of the body portion, and c. an elastic loop attached to said arm by engagement with a pair of brackets having a base at one end and a tip at the other spaced apart and attached at the base of said brackets to the top of said arm, said brackets spaced apart a distance less than the width of the elastic loop at the tip of said brackets and spaced apart at the base of said brackets a distance greater that the distance between said tips adapted for encircling the covers of the book and biasing said covers closed about said body portion.

13. A bookmark as described in claim 12 wherein said brackets have hook shaped ends disposed toward one another.

* * * * *